US005887919A

United States Patent [19]

Sallinen et al.

[11] Patent Number: 5,887,919

[45] **Date of Patent: *Mar. 30, 1999**

[54] SNOW PUSH SCOOP OF PLASTIC

[75] Inventors: Teuvo Sallinen, Rauma; Heikki Salo, Turku, both of Finland

[73] Assignee: Motoseal Components Oy, Rauma, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 780,887

[22] Filed: Jan. 9, 1997

[30] Foreign Application Priority Data

Jan. 16, 1996 [FI] Finland ..... U960029

[51] Int. Cl.[6] ..... E01H 5/02

[52] U.S. Cl. ..... 294/54.5; 37/265

[58] Field of Search ..... 294/49, 54.5, 55, 294/57; 15/257.1, 257.7, 257.8, 257.9; 37/264, 265, 285

[56] References Cited

U.S. PATENT DOCUMENTS

| | | | |
|---|---|---|---|
| 586,919 | 7/1897 | Vuillier | 15/257.8 |
| 849,239 | 4/1907 | Hill | 15/257.9 |
| 940,422 | 11/1909 | Ballman | 15/257.8 |
| 2,648,959 | 8/1953 | Budzyna | 15/257.7 |
| 3,278,969 | 10/1966 | Wenzlaff et al. | 15/257.7 |
| 3,380,772 | 4/1968 | Lissakers | 294/54.5 |
| 3,475,838 | 11/1969 | Hagen et al. | 294/54.5 |
| 3,583,746 | 6/1971 | Lissakers | 294/54.5 |
| 4,125,951 | 11/1978 | Huerth | 37/265 |
| 4,193,626 | 3/1980 | Vondracek | 294/54.5 |
| 4,245,411 | 1/1981 | McMath | 294/54.5 |
| 4,248,466 | 2/1981 | Carper | 294/54.5 |
| 4,531,713 | 7/1985 | Balboni | 294/54.5 |

FOREIGN PATENT DOCUMENTS

| | | | |
|---|---|---|---|
| 3306-625 | 8/1984 | Germany | 15/257.1 |
| 416659 | 1/1981 | Sweden . | |

*Primary Examiner*—Dean Kramer
*Attorney, Agent, or Firm*—Baker & Botts,L.L.P.

[57] ABSTRACT

The invention relates to a snow push scoop (2) of plastic comprising a bottom portion, side portions and a rear portion. A tubular hollow (4) is formed inside an upper edge of the rear portion of the scoop (2), i.e. inside the rear edge (2*c*). The rear edge (2*c*) of the scoop (2) is then rigid, and no transverse tube is needed for a handle (3) of the snow push (1), for instance. Further, the scoop (2) has a light structure and the snow push (1) as a whole is simple to manufacture.

6 Claims, 1 Drawing Sheet

SNOW PUSH SCOOP OF PLASTIC

Figure 1:
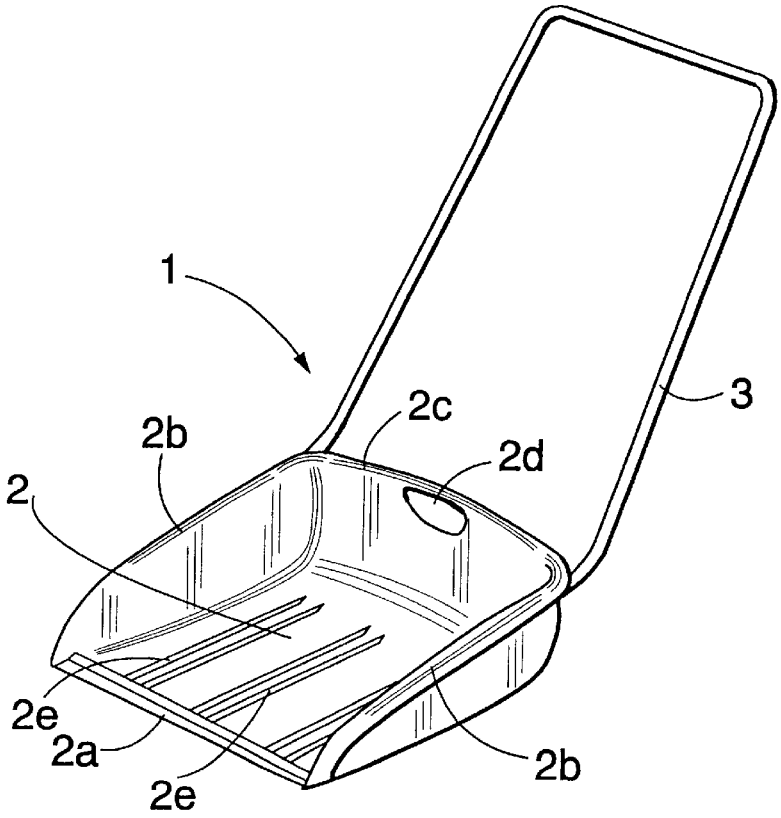

The invention relates to a snow push scoop of plastic comprising a bottom portion, side portions and a rear portion.

A snow push scoop is typically formed for instance by injection moulding or by hot moulding a plastic sheet in such a way that the side and rear edges of the scoop are provided with flanges. On the other hand, an A-shaped snow push handle is typically formed of a tube in such a way that the legs of the handle are fastened below the side edges of the scoop, and respectively, a transverse tube joining the legs can be fastened below the bent rear edge of the scoop. This transverse tube is required to secure the rigidity of the handle, because the handle is exposed to all torsional stresses, for instance. However, several stages of manufacture are required for making such a snow push. Moreover, the handle comprises several joints weakening the total durability of the snow push. Further, the transverse tube increases the weight of the snow push.

Snow push scoops of plastic without a transverse steel tube are also known. Attempts have been made to reinforce and stiffen the rear edge thereof e.g. by means of ribs, but sufficiently rigid solutions have not been achieved in this way. Then it is necessary to make the scoop narrow and the handle thick and heavy, accordingly.

U.S. Pat. No. 4,248,466 discloses a snow push comprising a double-walled and hollow scoop formed of plastic by the blow moulding procedure. Such a scoop is thick, clumsy and heavy. In addition, rather much material is required for the manufacture.

Snow push scoops can also be manufactured of metal, but the material costs for snow pushes then easily rise high. Further, it is very difficult to manufacture such a snow push sufficiently light in weight for working purposes. In addition, metal pushes have poor sliding properties and they also are exposed to corrosion.

The object of the invention is to provide a snow push scoop having an advantageous manufacturing technique and a rigid and light structure.

The snow push scoop according to the invention is characterized in that a tubular hollow is formed inside an upper edge of the rear portion of the scoop, i.e. inside the rear edge.

The essential idea of the invention is that when a scoop is manufactured of plastic e.g. by injection moulding, at least the rear edge of the scoop is formed substantially tubular. Further, the idea of a preferred embodiment is that the side edges of the scoop are formed substantially tubular. The idea of still another preferred embodiment is that a hollow is formed inside a front edge of the scoop.

An advantage of the invention is that the tubular rear edge of the scoop manufactured of plastic by injection moulding is rigid and no transverse tube is required for the handle of the snow push, for instance. It is then possible to make also the scoop bear more stresses, and the structure and joints of the handle can be simplified. Moreover, a handle without a transverse tube takes much less space during manufacture and transport than a handle provided with a transverse tube. In addition, the scoop has a light structure and the snow push as a whole is simple to manufacture. Further, the hollow formed inside the front edge increases the durability of the front edge, due to which it may even be possible to exclude an additional cover of the front edge.

Figure 2:
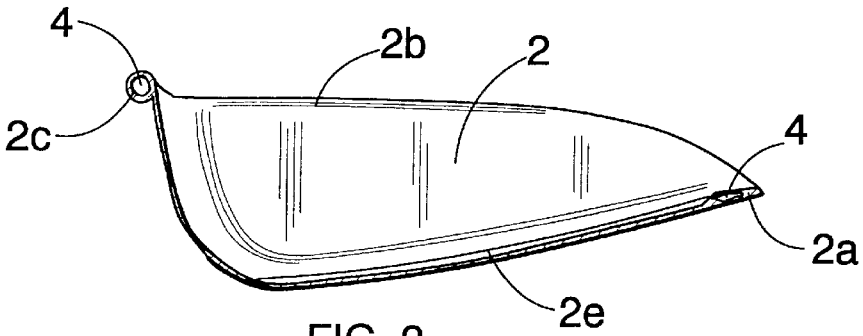
Figure 3:
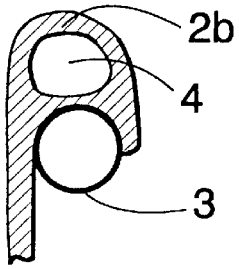

The invention will be explained in greater detail in the attached drawing, in which FIG. 1 shows a snow push provided with a scoop according to the invention, FIG. 2 shows a side view of the snow push scoop according to the invention in cross-section and FIG. 3 shows a cross-section of the side edge of the scoop according to FIG. 2.

FIG. 1 shows a snow push 1. The snow push 1 comprises a scoop 2 of plastic and a handle 3 attached thereto. The plastic material used can be e.g. HD polyethylene or polypropylene. The scoop 2 comprises a bottom portion, side portions and a rear portion in a manner known per se. A front edge 2*a* of the scoop 2 is bevelled off so that the snow to be removed can be gathered up as well as possible, which means that tidy work is done. The front edge 2*a* must also be strong enough to resist impacts, e.g. bumping against stones or lumps of ice. The front edge 2*a* can be reinforced e.g. by fitting a sheet metal thereon. According to the invention, upper edges of the side portions, i.e. side edges 2*b*, are made hollow when injection moulding the scoop 2 of plastic, due to which their durability improves. Though their outer dimension is bigger than earlier, the weight of the scoop 2 does not increase substantially, however. The handle 3, typically formed of metal tube, is fastened for instance with screws below the side edges 2*b*. Further, an upper edge of the rear portion, i.e. rear edge 2*c*, is made tubular, due to which the rear edge 2*c* can be made so rigid that no separate horizontal tube needs to be attached to the handle 3 to support the rear edge 2*c*. The tubular rear edge makes the rear portion of the scoop rigid, but the tubular form does not even here increase the weight of the scoop or the manufacturing costs substantially, since the remaining part of the scoop consists of single-layer plastic of normal thickness. It is easy to make an aperture 2*d* in the rear portion of the scoop 2, due to which the aperture 2*d* and the rear edge 2*c* together can form a carrying handle, at which the snow push 1 is easy to move and carry. The carrying handle then consists of the rear edge 2*c*, which has been made rigid according to the invention. The bottom portion can be provided with elevations 2*e*. At least part of the elevations 2*e* can be formed hollow while injection moulding, whereby the elevations 2*e* make the bottom portion of the scoop 2 more rigid without substantially increasing the weight of the scoop 2, however.

FIG. 2 shows a side view of the snow push scoop 2 in cross-section. The numbering of FIG. 2 corresponds to that of FIG. 1. The rear edge 2*c* has been made tubular, due to which there is a hollow 4 inside the rear edge 2*c*. The hollow 4 does not need to be symmetric nor symmetrically located in the middle of the rear edge 2*c*. It is not absolutely necessary either that the outer edge of the rear edge has a round cross-section, but an oval cross-section, for instance, is also possible. Accordingly, the term tubular comprises all these shapes of cross-sections of the outer edge of the rear edge 2*c* and the hollow 4. One or more hollows 4 can be formed also inside the front edge 2*a*, by means of which the structure of the front edge 2*a* can be stiffened. Most preferably, a hollow 4 can be provided inside the edges by gas assisted injection moulding. This procedure consists in that, while the scoop is injection moulded, e.g. nitrogen or some other gas, besides plastic material, is led into an injection mould, which means that a hollow 4 is created inside the plastic. Said gas can be fed either from the same point as the plastic or from one or more points elsewhere in the product.

FIG. 3 shows the side edge 2*b* of the scoop in cross-section. The numbering of FIG. 3 corresponds to that of the FIGS. 1 and 2. To stiffen the side edge 2*b*, it may be provided with a tubular structure, i.e. a hollow 4 may be formed therein. At least part of the side edge 2*b* is shaped preferably concave below, due to which the handle 3 can be fixed firmly below the side edge 2*b*.

The drawing and the related description are only intended to illustrate the idea of the invention. As to the details, the invention may vary within the scope of the claims. The scoop 2 may thus comprise, besides the handle 3, additional bows or supports, for instance. Further, the scoop 2 may comprise e.g. other grooves or elevations in a fully known manner.

We claim:

1. Snow push scoop of plastic comprising a bottom portion, side portions and a rear portion, wherein a tubular hollow is integrally formed within and parallel to an upper edge of the rear portion of the scoop; wherein said bottom portion, side portions and rear portion are solid; wherein said tubular hollow is substantially free of solid material; and wherein said scoop includes a handle attached to said side portions, such that said handle is substantially perpendicular to said tubular hollow and is adjacent to and supports an upper edge of each of said side portions.

2. Snow push scoop according to claim 1, wherein an aperture is formed in the rear portion of the scoop so that the upper edge of the rear portion forms a carrying handle.

3. Snow push scoop according to claim 1, wherein the bottom portion of the scoop comprises elevations, a hollow being formed inside at least one elevation.

4. Snow push scoop of plastic comprising a bottom portion, side portions and a rear portion, wherein a tubular hollow is integrally formed within an upper edge of the rear portion of the scoop; wherein said bottom portion, side portions and rear portion are solid; wherein said tubular hollow is substantially free of solid material, wherein a tubular hollow is formed inside upper edges of the side portions of the scoop and wherein said scoop includes a handle attached to said side portions, such that said handle is substantially parallel to said tubular hollow along said side portions and adjacent to said upper edge of each of said side portions.

5. Snow push scoop according to claim 4, wherein each of said side portions includes a substantially concave, handle receiving groove, adjacent to said tubular hollow.

6. Snow push scoop of plastic comprising a bottom portion, side portions and a rear portion, wherein a tubular hollow is formed inside an upper edge of the rear portion of the scoop, wherein said bottom portion, side portions and rear portion are solid, and wherein said tubular hollow is substantially free of solid material, wherein a hollow is formed inside a front edge of the scoop.

* * * * *